US010501219B2

(12) United States Patent
Rausch et al.

(10) Patent No.: US 10,501,219 B2
(45) Date of Patent: Dec. 10, 2019

(54) COMBINATION CHAMBER AND EXTERNAL SUCTION VACUUM PACKAGING MACHINE

(71) Applicant: Hantover, Inc., Overland Park, KS (US)

(72) Inventors: David A. Rausch, Lawrence, KS (US); Bernard G. Huff, Belton, MO (US)

(73) Assignee: Hantover, Inc., Overland Park, KS (US)

( * ) Notice: Subject to any disclaimer, the term of this patent is extended or adjusted under 35 U.S.C. 154(b) by 330 days.

(21) Appl. No.: 15/651,635

(22) Filed: Jul. 17, 2017

(65) Prior Publication Data

US 2017/0313454 A1 Nov. 2, 2017

Related U.S. Application Data

(63) Continuation of application No. 14/469,375, filed on Aug. 26, 2014, now Pat. No. 9,708,088.

(60) Provisional application No. 61/869,786, filed on Aug. 26, 2013.

(51) Int. Cl.

| | |
|---|---|
| ***B65B 31/02*** | (2006.01) |
| ***B65B 51/14*** | (2006.01) |
| ***B65B 31/04*** | (2006.01) |

(52) U.S. Cl.

CPC ..... *B65B 31/024* (2013.01); *B65B 31/048* (2013.01); *B65B 51/148* (2013.01)

(58) Field of Classification Search

CPC ... B65B 31/024; B65B 31/048; B65B 51/148; B65B 51/10; B65B 51/146

USPC ..... 53/405, 86, 374.8, 374.4, 512, 510, 434

See application file for complete search history.

(56) References Cited

U.S. PATENT DOCUMENTS

| | | | | | |
|---|---|---|---|---|---|
| 3,958,391 | A * | 5/1976 | Kujubu | B65B 31/022 | 53/434 |
| 4,164,111 | A * | 8/1979 | Di Bernardo | B65B 31/024 | 53/434 |
| 4,182,095 | A * | 1/1980 | Day | B65B 31/024 | 53/512 |
| 4,640,081 | A * | 2/1987 | Kawaguchi | B65B 9/067 | 198/463.3 |
| 4,779,398 | A * | 10/1988 | Glandon | B65B 31/022 | 53/434 |
| 5,239,808 | A * | 8/1993 | Wells | B29C 65/228 | 53/512 |
| 5,682,727 | A * | 11/1997 | Harte | B65B 31/024 | 53/434 |
| 7,146,783 | B2 * | 12/2006 | Levsen | B65B 31/046 | 53/512 |
| 2003/0159405 | A1 * | 8/2003 | Knowlton | B29C 65/743 | 53/434 |
| 2004/0031245 | A1 * | 2/2004 | Kingeter | B65B 31/02 | 53/510 |

(Continued)

*Primary Examiner* — Robert F Long
*Assistant Examiner* — Xavier A Madison
(74) *Attorney, Agent, or Firm* — Hovey Williams LLP

(57) ABSTRACT

A combination chamber and external suction vacuum packaging machine is operable to evacuate a vacuum bag and seal closed an open margin of the bag. The vacuum packaging machine includes a base and a lid that define a vacuum chamber operable for use in a chamber packaging operation, where the bag is entirely received within the vacuum chamber, and an external packaging operation, where only part of the bag is received within the vacuum chamber.

20 Claims, 7 Drawing Sheets

(56) References Cited

U.S. PATENT DOCUMENTS

| | | | | |
|---|---|---|---|---|
| 2005/0011166 | A1* | 1/2005 | Germano | B65B 31/024<br>53/512 |
| 2015/0135641 | A1* | 5/2015 | Hu | B65B 51/10<br>53/86 |

* cited by examiner 142
134
172
132
170
160
146
90
32
152
94
144
166
168
24
140
156
174

142
170
134
132
172
160
146
90
32
152
94
144
166
168
24
140
156
174

166
168
24
169
156
90
T
152
94
144
32
169
140
156
166
168

COMBINATION CHAMBER AND EXTERNAL SUCTION VACUUM PACKAGING MACHINE

RELATED APPLICATION

This is a continuation of prior application Ser. No. 14/469,375, filed Aug. 26, 2014, entitled COMBINATION CHAMBER AND EXTERNAL SUCTION VACUUM PACKAGING MACHINE, which claims the benefit of U.S. Provisional Application Ser. No. 61/869,786, filed Aug. 26, 2013, entitled COMBINATION CHAMBER AND EXTERNAL SUCTION VACUUM PACKAGING MACHINE, each of which is hereby incorporated in its entirety by reference herein.

BACKGROUND

1. Field

The present invention relates generally to vacuum packaging machines used to seal contents in a vacuum bag. More specifically, embodiments of the present invention concern a vacuum packaging machine configured for use in a chamber packaging operation, where the bag and the contents to be sealed therein are entirely received within the vacuum chamber of the machine, or an external packaging operation, where only part of the bag is received within the vacuum chamber.

2. Discussion of Prior Art

Vacuum packaging machines have long been used to seal contents in vacuum bags made of synthetic resin material. While such machines are typically used to seal foodstuffs for storage and later consumption, other items can be vacuum packaged as well. In general, prior art machines seal contents within a vacuum bag by evacuating air from the bag to achieve a vacuum condition while retaining substantially all of the contents within the bag. While maintaining the vacuum condition, the machine then seals the contents within the bag by activating a heated sealing mechanism. The mechanism melts the panels of the bag to one another along a seal line to seal the open margin closed.

One prior art machine for conventional vacuum packaging is an external packaging system where only part of the bag (i.e., the open margin) is positioned within the vacuum chamber, while the remainder of the bag and the contents being sealed are outside of the vacuum chamber. Another prior art machine for conventional vacuum packaging is a chamber packaging system where the vacuum bag and the contents being sealed are positioned entirely within the vacuum chamber.

However, the prior art vacuum packaging machines have various deficiencies. For instance, conventional external packaging systems draw any liquid contents within the bag toward the open margin during air evacuation. This can lead to liquid migrating out of the bag and onto surfaces within the vacuum chamber. The liquid can also move to a location along the seal line such that the liquid interferes with proper sealing of the vacuum bag. Prior art chamber packaging systems are deficient because the size of the vacuum chamber limits the size of the contents to be sealed in the vacuum bag.

SUMMARY

The following brief summary is provided to indicate the nature of the subject matter disclosed herein. While certain aspects of the present invention are described below, the summary is not intended to limit the scope of the present invention.

Embodiments of the present invention provide a combination vacuum packaging machine that does not suffer from the problems and limitations of the prior art vacuum packaging systems, as set forth herein and as otherwise understood by those of ordinary skill in the art.

A first aspect of the present invention concerns a combination chamber and external suction vacuum packaging machine operable to evacuate a vacuum bag and seal closed an open margin of the bag. The vacuum packaging machine broadly includes a base, a lid, a vacuum source, a seal bar, and a compressible seal. The lid is shiftably supported relative to the base for movement into and out of a closed position. The base and the lid cooperatively define a vacuum chamber when the lid is in the closed position. The vacuum chamber is dimensioned and configured for use in a chamber packaging operation, wherein the bag is entirely received within the vacuum chamber, and an external packaging operation, wherein the margin and only part of the bag is received within the vacuum chamber. The vacuum source is in communication with the vacuum chamber. The vacuum source is operable to evacuate the vacuum chamber and thereby the vacuum bag through the open margin thereof, during chamber packaging and external packaging operations. The seal bar is operable to engage and seal closed the open margin of the vacuum bag after the vacuum bag has been evacuated. The base and the lid present respective seal faces, with the seal faces being opposed to one another and spaced apart to define a sealing gap therebetween when the lid is in the closed position. The compressible seal is configured to span the sealing gap and sealingly engage the seal faces during evacuation of the vacuum chamber and vacuum bag. The seal faces move toward one another to decrease the sealing gap as the seal is compressed during evacuation of the vacuum chamber and vacuum bag. At least one of the base and the lid presents a projecting stop configured to engage the other of the base and the lid during chamber packaging and external packaging operations to limit compression of the seal and thereby define a minimum seal gap dimension.

A second aspect of the present invention concerns a method of evacuating and sealing vacuum bags. The method broadly includes the steps of placing a first vacuum bag entirely within a vacuum chamber of a vacuum packaging machine; then evacuating the first vacuum bag through an open margin thereof; sealing the open margin of the first vacuum bag closed after the first vacuum bag has been evacuated; removing the first vacuum bag from the vacuum chamber after the first vacuum bag has been sealed; placing a second vacuum bag only partly within the vacuum chamber so that the open margin thereof is located within the vacuum chamber; then evacuating the second vacuum bag through the open margin thereof; sealing the open margin of the second vacuum bag closed after the second vacuum bag has been evacuated; and removing the second vacuum bag entirely from the vacuum chamber after it has been sealed.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the present invention will be apparent from the following detailed description of the embodiments and the accompanying drawing figures.

BRIEF DESCRIPTION OF THE DRAWING FIGURES

Preferred embodiments of the invention are described in detail below with reference to the attached drawing figures, wherein.

Figures 9, 10, 11:
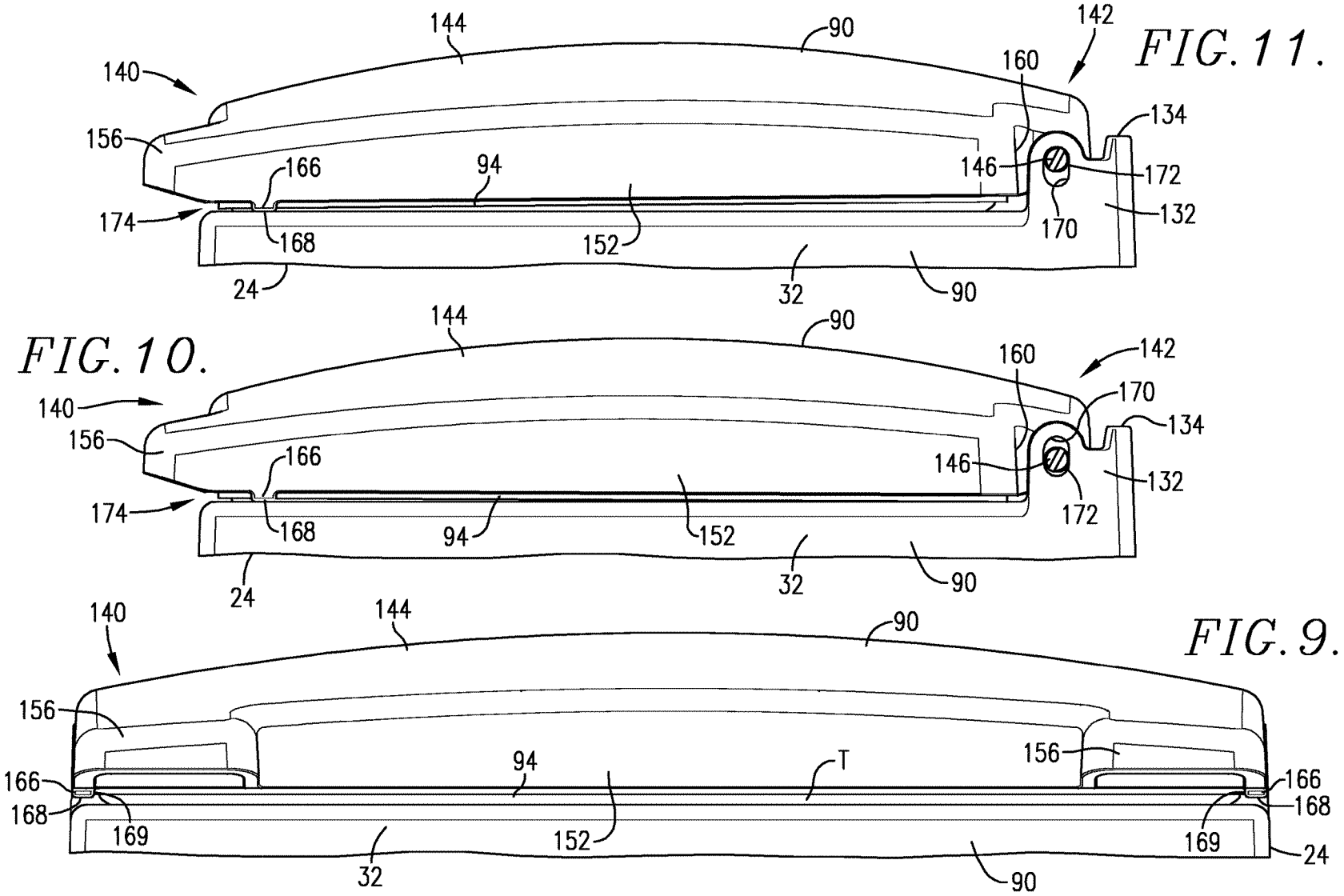
FIG. 9 is a fragmentary front elevation of the vacuum packaging machine shown in FIGS. 1-8, showing the lid in a first intermediate position between the open and closed lid positions where an edge of the seal engages the container base.
FIG. 10 is a fragmentary side elevation of the vacuum packaging machine shown in FIGS. 1-9, showing the lid in a second intermediate position between the open and closed lid positions where the seal is fully compressed along a proximal end of the lid so that a projecting stop of the lid engages the container base, with the seal being less than fully compressed adjacent the hinged end of the lid.
FIG. 11 is a fragmentary side elevation of the vacuum packaging machine similar to FIG. 10, but showing the seal fully compressed adjacent the hinged end of the lid.
Figure 12:
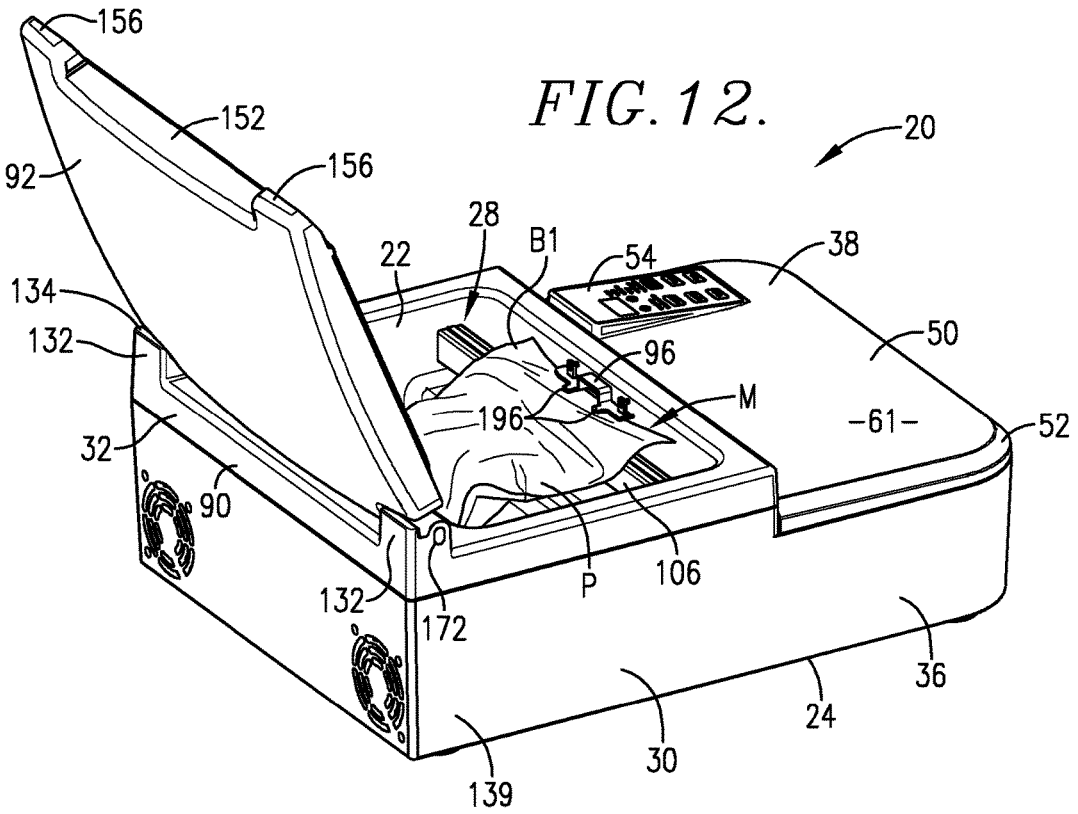
Figure 13:
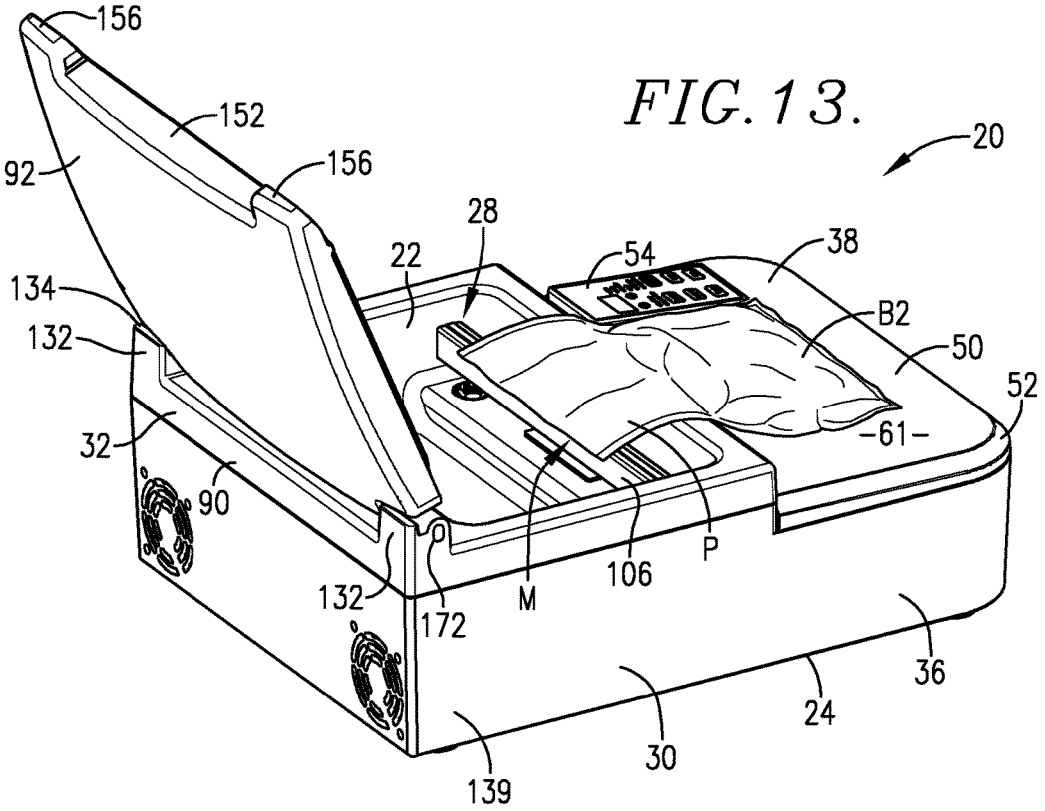

FIG. 12 is a rear perspective of the vacuum packaging machine shown in FIGS. 1-11, showing a first vacuum bag positioned on the machine for a chamber packaging operation where a vacuum bag is located entirely in the vacuum chamber; and FIG. 13 is a rear perspective of the vacuum packaging machine similar to FIG. 12, but showing a second vacuum bag positioned on the machine for an external packaging operation where the second vacuum bag extends only partly into the vacuum chamber.

The drawing figures do not limit the present invention to the specific embodiments disclosed and described herein. The drawings are not necessarily to scale, emphasis instead being placed upon clearly illustrating the principles of the preferred embodiment.

DETAILED DESCRIPTION OF THE PREFERRED EMBODIMENTS

Figure 1:
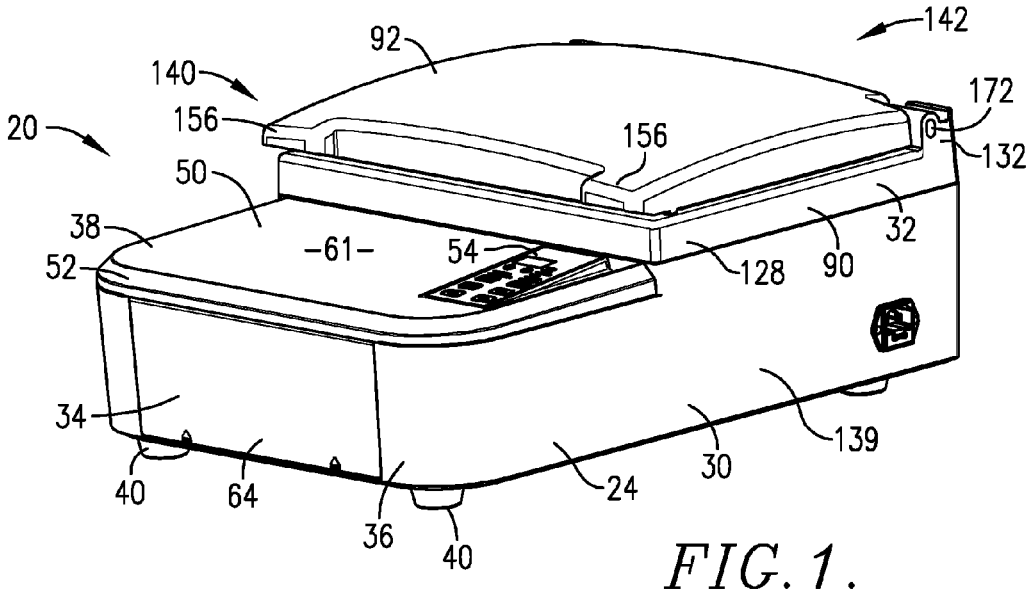
FIG. 1 is a front right perspective of a combination chamber and external suction vacuum packaging machine constructed in accordance with a preferred embodiment of the present invention, showing a container lid of the machine in a closed lid position to engage a container base, with the lid and base cooperatively enclosing a vacuum chamber, and showing a fold-out tray in a retracted position.
Figure 2:
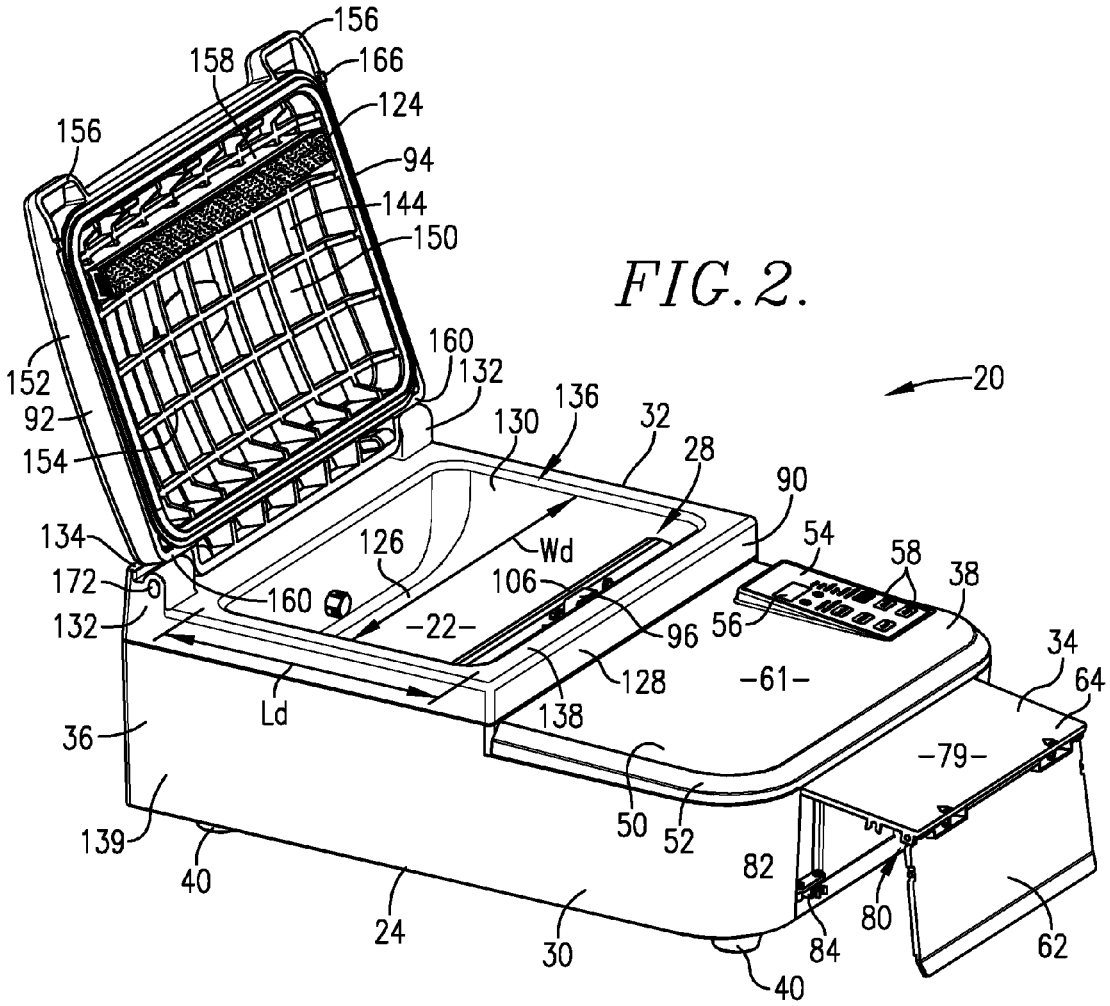
FIG. 2 is a front left perspective of the vacuum packaging machine similar to FIG. 1, but showing the lid of the machine swung to an open lid position to expose the vacuum chamber and permit chamber ingress and egress, and the fold-out tray of the machine deployed to provide a laterally extending tray support surface.
Figure 4:
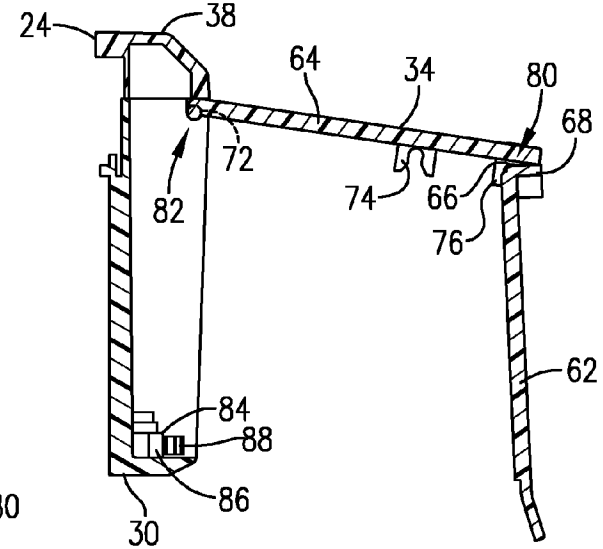
FIG. 4 is a fragmentary cross section of the vacuum packaging machine shown in FIGS. 1-3, particularly depicting details of the fold-out tray, including a lip of the support leg engaging an outer margin of the tray top to restrict further unfolding of the support leg.
Figure 3:
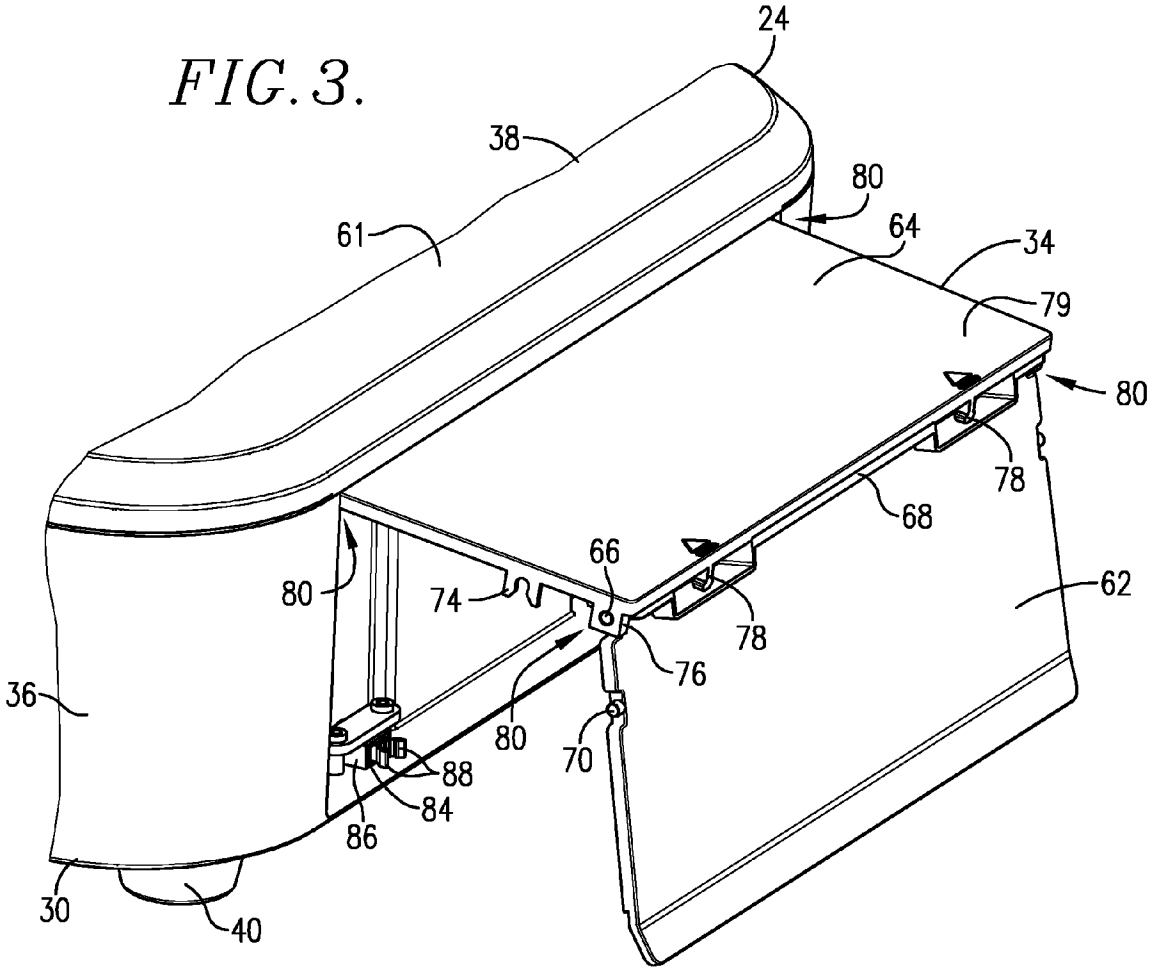
FIG. 3 is an enlarged fragmentary perspective of the vacuum packaging machine shown in FIGS. 1 and 2, showing a tray top and support leg of the fold-out tray unfolded from the housing of the machine so that the tray is deployed.

Turning initially to FIGS. 1 and 2, a combination vacuum packaging machine 20 is constructed in accordance with a preferred embodiment of the present invention. Preferably, the illustrated machine 20 uses vacuum bags B1,B2 (see FIGS. 12 and 13) to vacuum package items in either a chamber packaging operation mode or an external packaging operation mode.

The vacuum bags B1,B2 are conventional and each include opposite bag panels that are attached to and overlie one another. The vacuum bag B1 is configured primarily for the chamber packaging operation and includes panels that both preferably present smooth interior surfaces. As will be appreciated, the bag B1 could also be used for the external packaging operation, although the smooth panels of the bag B1 may result in the open margin of the bag B1 being pinched closed by the lid of the machine 20 during evacuation. However, it is known that a conventional vacuum bag with smooth panels and a textured insert positioned between the panels can be used for external packaging because the insert presents at least one textured surface that restricts the open margin of the bag from being pinched closed by the lid.

The vacuum bag B2 is configured primarily for the external packaging operation and includes one panel that presents a smooth interior surface and another panel that presents a textured interior surface (not shown). During the external packaging operation, it will be understood that the textured interior surface is designed to restrict the open margin of the bag B2 from being pinched closed by the lid of the machine 20 during evacuation. However, the bag B2 can also be used for the chamber packaging operation to vacuum package items.

While the vacuum bags B1,B2 are described for use with the machine 20, it will be appreciated that other vacuum bags could be used without departing from the scope of the present invention. For instance, as discussed above, an alternative bag could include a textured insert to restrict the open margin of the bag from being pinched closed.

In the chamber packaging mode, the machine 20 operates as a chamber vacuum packaging system to vacuum package one or more items (not shown) in the vacuum bag B1 (see FIG. 12). That is, in the chamber packaging mode, the entire vacuum bag B1 and the contents thereof (not shown) are located entirely within a vacuum chamber 22 of the machine 20 during evacuation of the vacuum bag B1.

In the external packaging mode, the machine 20 operates as an external vacuum packaging machine to vacuum package one or more items (not shown) in the vacuum bag B2 (see FIG. 13). That is, in the external packaging mode, the vacuum bag extends only partly into the vacuum chamber 22 so that part of the vacuum bag B2 is located within the vacuum chamber 22, with the remainder of the bag B2 and the contents thereof (not shown) being located outside of the vacuum chamber 22.

As used herein, the term "evacuation" preferably refers to removal of substantially all air within the vacuum chamber 22 and within the vacuum bag. More preferably, "evacuation" does not include removal of any contents of the vacuum bag other than air. The term "vacuum" refers to a space that has been at least partly evacuated of air using a vacuum pump.

Similar to conventional vacuum packaging systems, the machine 20 is typically used to vacuum package various foodstuffs (in solid and/or liquid form). However, it is within the scope of the present invention where the machine 20 is employed to vacuum package items (in solid and/or liquid form) other than foodstuffs. The illustrated machine 20 broadly includes a housing 24, an evacuation system 26, and a bag seal system 28.

Turning to FIGS. 1-6, the illustrated housing 24 preferably includes a cabinet 30, a vacuum container 32 supported by the cabinet 30, and a stowable shelf assembly 34 shiftably mounted on the cabinet 30.

The depicted cabinet 30 includes a molded cabinet base 36, an access cover 38, and feet 40. The cabinet base 36 includes a lowermost wall 42 and upright walls 44 integrally formed with the lowermost wall 42 (see FIGS. 5 and 6). The walls 42,44 cooperatively form interior compartments 46,48 that receive other elements of the machine 20 (see FIG. 5).

Figure 5:
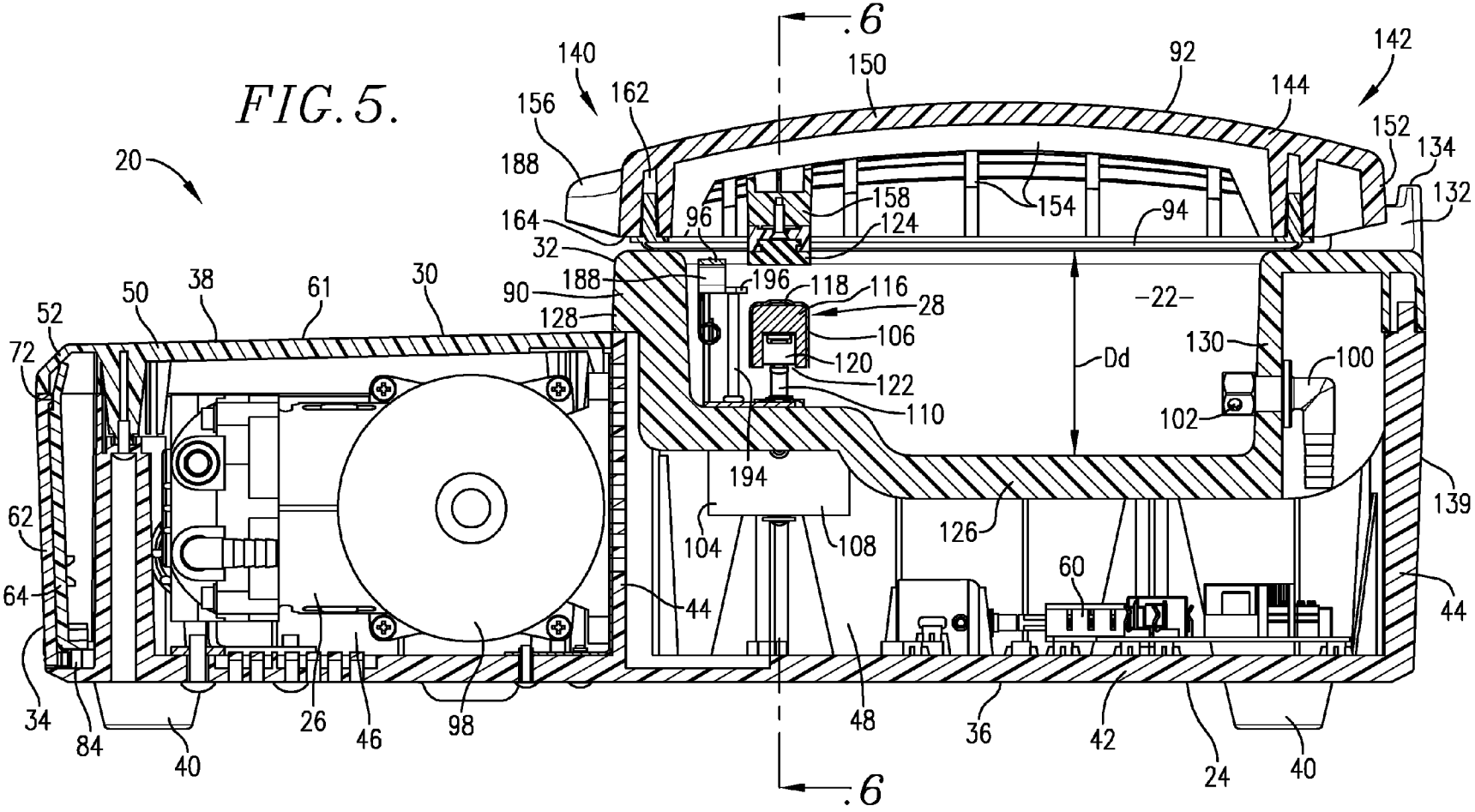
FIG. 5 is a longitudinal cross section of the vacuum packaging machine shown in FIGS. 1-4, showing the lid in the closed position and the fold-out tray in the retracted position, and showing an evacuation system and a bag seal system of the machine, with a bag clamp adjacent the bag seal system being closed.

The access cover 38 includes a body 50, an outer rim 52, and an electronic operator interface 54 (see FIGS. 1, 2, and 5). In the usual manner, the operator interface 54 includes an LED display 56 and multiple switches 58 for a user to control operation of the machine 20 (see FIG. 2). The operator interface 54 is operably connected to a controller 60 of the machine 20 (see FIG. 5). The access cover 38 is removably secured to the cabinet base so as to cover the interior compartment 46. The access cover 38 also presents a bag-supporting surface 61 that is particularly configured to receive the vacuum bag B2 and any contents during the external packaging operation (see e.g., FIG. 13).

The cabinet base 36 and access cover 38 each preferably include a synthetic resin material that is molded to form a rigid structure. However, it is within the scope of the present invention where the cabinet base 36 and access cover 38 include one or more alternative materials (e.g., stainless steel, aluminum, etc.).

Turning to FIGS. 1-5, the shelf assembly 34 is preferably in the form of a fold-out tray and is positionable in a bag-supporting condition (see FIGS. 2-4), in which the shelf assembly 34 is especially suited to support vacuum bag B2 and contents contained therein before, during, and/or after the vacuum bag B2 is evacuated and sealed. If desired, the shelf assembly 34 may also be used to support the bag B1 before and after chamber packaging operations. The shelf assembly 34 preferably includes a support leg 62 and a shelf top 64 attached to the cabinet 30. The illustrated support leg 62 includes a generally planar panel, hinge pins 66, a lip 68 that extends between the hinge pins 66, and projections 70 (see FIGS. 3 and 4). The shelf top 64 preferably includes a generally planar panel, hinge pins 72, catches 74, hinge tabs 76, and latch connectors 78. The shelf top 64 presents a bag-supporting face 79 that extends generally from the bag-supporting surface 61 when the shelf assembly 34 is in the bag-supporting condition (see FIG. 3). In the bag-supporting condition, the bag-supporting surface 61 and the bag-supporting face 79 can cooperate to partly support the vacuum bag B2 (e.g., during the external packaging operation).

While the support leg 62 and shelf top 64 both preferably comprise continuous unitary panels, it is within the scope of the present invention where the leg 62 and top 64 are alternatively shaped.

The support leg 62 and shelf top 64 are pivotally attached to one another by inserting the hinge pins 66 into the hinge tabs 76 to form hinge joints 80. The hinge joints 80 allow the support leg 62 to be swung relative to the shelf top 64 between a folded position (see FIGS. 1 and 5) and an unfolded position (see FIGS. 2-4). In the folded position, the catches 74 releasably engage and grasp the projections 70 and restrict the projections 70 from being moved out of engagement with the catches 74. As the support leg 62 is swung into the folded position, the catches 74 and projections 70 snap into engagement. Similarly, as the support leg 62 is swung out of the folded position, the catches 74 and projections 70 snap out of engagement. When the support leg 62 is unfolded, the lip 68 preferably engages an outer margin of the shelf top 64 to restrict further pivoting of the support leg beyond the unfolded position (see FIG. 4).

The shelf top 64 is also pivotally attached to the cabinet 30 by inserting the hinge pins 72 into hinge openings (not shown) presented by the cabinet 30 to form hinge joints 82. The shelf top 64 pivots relative to the cabinet 30 between a retracted position (see FIGS. 1 and 5) and an extended position (see FIGS. 2-4). Thus, when the shelf top 64 is extended and the support leg 62 is unfolded to engage a work surface (not shown), the shelf assembly 34 is deployed in the bag-supporting condition and can receive at least part of the vacuum bags, as noted above.

When the support leg 62 is swung to the folded position, the support leg 62 and shelf top 64 can both be pivoted to the retracted position (see FIG. 5). In the retracted position, the latch connectors 78 are removably secured to latches 84 mounted on the cabinet 30. Each latch 84 includes a housing 86 and a pair of fingers 88 (see FIGS. 3 and 4). The fingers 88 slide into the housing 86 in the retracted position to secure the corresponding latch connector 78 relative to the housing 86. The fingers 88 are slidable out of the housing 86 from the retracted position to a releasing position where the latch connector 78 can be selectively snapped into or out of engagement with the fingers 88 (see FIGS. 3 and 4).

While the illustrated structure of the shelf assembly 34 is preferred, it is within the scope of the present invention where components of the shelf assembly 34 are alternatively structured and/or configured to operate. For instance, instead of unfolding from the retracted position, the support leg 62 and shelf top 64 could be constructed to translate out of the retracted position where the support leg 62 and shelf top 64 reside within a pocket presented within the cabinet.

Figure 6:
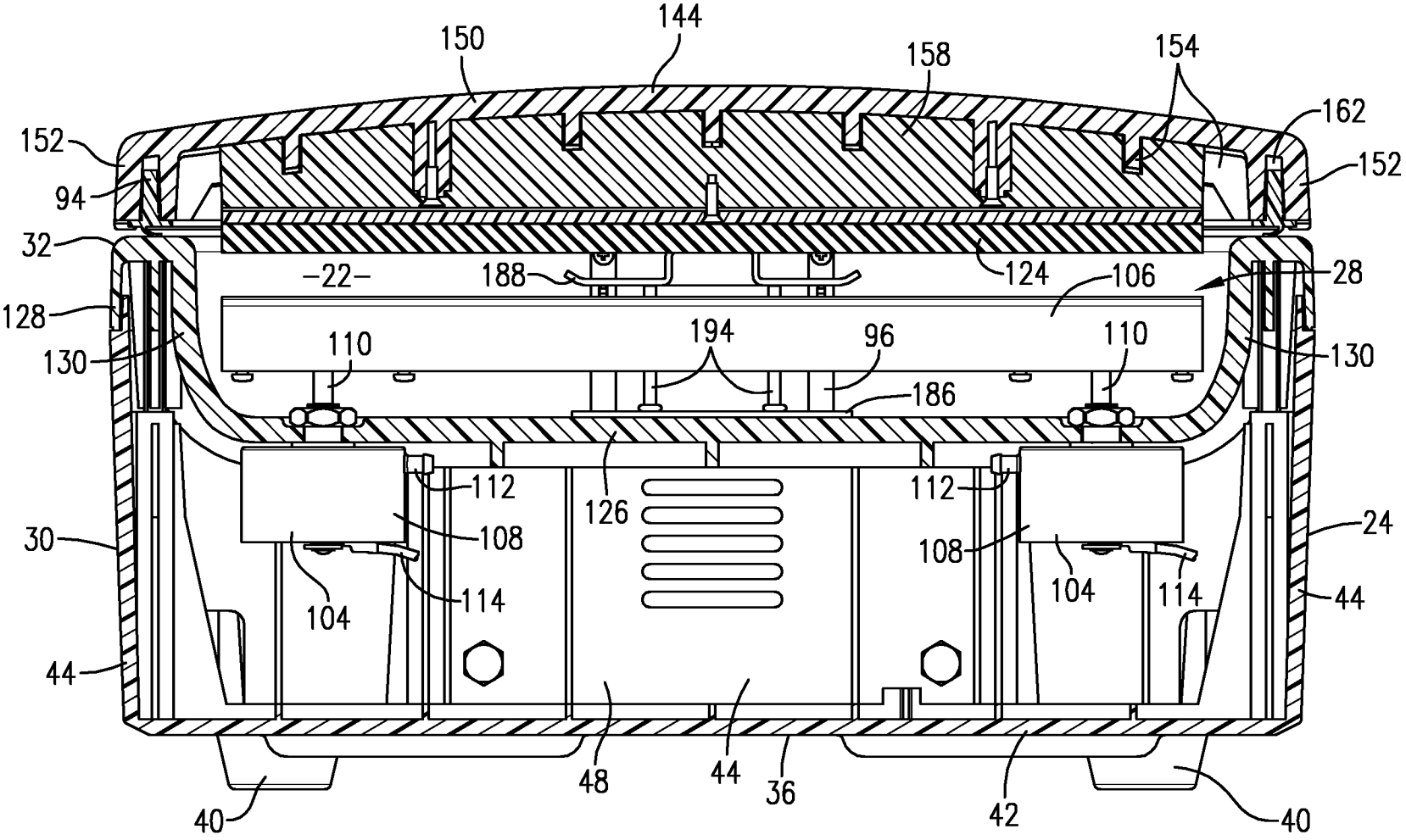
FIG. 6 is a lateral cross section of the vacuum packaging machine shown in FIGS. 1-5, showing pneumatic cylinders and a seal bar of the bag seal system, with the seal bar being spaced below a seal strip of the lid.
Figure 7:
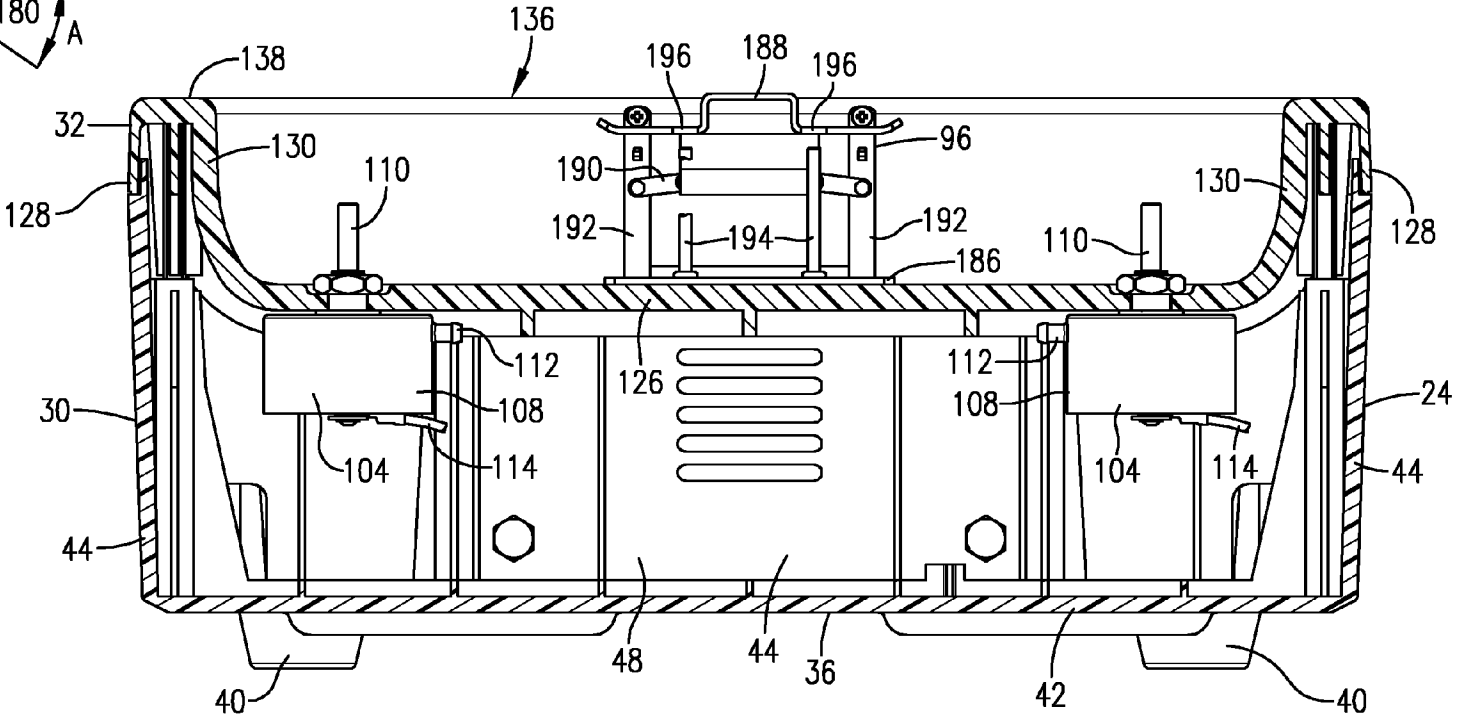
FIG. 7 is a fragmentary cross section of the vacuum packaging machine similar to FIG. 6, but showing the lid and the seal bar removed and also showing the bag clamp open to receive a vacuum bag.

Turning to FIGS. 5-7, the vacuum container 32 defines the vacuum chamber 22, which at least partly receives the vacuum bag B1,B2 to permit evacuation and sealing of the vacuum bag B1,B2. It will be appreciated that the vacuum chamber 22 can also receive a section of tubular vacuum bag material (not shown) to permit sealing of one end of the section without evacuating the section (e.g., when both ends of the section are initially open).

The vacuum container 32 preferably includes a container pan 90, a container lid 92, an elongated compressible seal 94, and a bag clamp 96. As will be discussed, the lid 92 is shiftably attached to the pan 90 and is movable between an open position (see FIG. 2) that allows access to the vacuum chamber 22 and a closed position (see FIG. 1) that permits air within the vacuum chamber 22 to be evacuated. The pan 90, lid 92, and seal 94 cooperatively form the vacuum chamber 22.

Referring again to FIGS. 5-7, the evacuation system 26 operates to selectively remove air from the vacuum chamber 22 to evacuate the vacuum bag B1,B2. The evacuation system 26 preferably includes a vacuum pump 98, a manifold fitting 100 that defines a vacuum port 102 within the chamber 22, and a vacuum line (not shown) that fluidly connects the vacuum pump 98 and the vacuum port 102 (see FIG. 5). The vacuum pump 98 is operable to draw air from the vacuum chamber 22 via the vacuum line and vacuum port 102.

The bag seal system 28 is preferably configured to close off an open margin M (see FIGS. 12 and 13) of the vacuum bag B1,B2 by melting the bag panels P to one another along a laterally extending seal line (not shown). The bag seal system 28 preferably includes a pair of pneumatic cylinders 104 and a seal bar 106 (see FIGS. 5-7).

The illustrated cylinders 104 are preferably operable to raise and lower the seal bar 106 relative to the vacuum container 32 and transmit an electric current through the seal bar 106. Each cylinder 104 preferably includes a cylinder housing 108 and an elongated piston 110 (see FIG. 7). Each cylinder housing 108 supports a vacuum port 112 and the end of an electrical lead 114. The cylinder housing 108 presents a cylinder chamber (not shown) that slidably receives the piston 110. The cylinder housing 108 preferably includes a molded synthetic resin material, although the cylinder housing 108 could include other materials.

The piston 110 preferably includes an electrically conductive metal material and, more preferably, is made of brass. This construction allows the cylinder 104 to transmit an electrical current between the seal bar 106 and the respective electrical lead 114. However, the piston 110 could include other materials.

The cylinder chamber is in fluid communication with the vacuum pump via the vacuum port 112 and vacuum lines (not shown) so that the portion of the cylinder chamber above the piston can be selectively evacuated of air. By evacuating air from the cylinder chamber, the piston 110 is urged to move upwardly out of the cylinder housing 108. Similarly, by allowing air to return to the cylinder chamber above piston 110, the piston 110 is moved downwardly into the cylinder housing 108. Therefore, vacuum pressure is selectively supplied to the cylinders 104 when it is desired to begin the bag sealing process.

In the usual manner, the seal bar 106 is operable to selectively seal closed the open margin M of the vacuum bag B1,B2. The seal bar 106 preferably includes, among other things, an elongated beam 116, a conductive metal strip 118 supported along the top margin of the beam 116, and a pair of metal connectors 120 that present sockets 122 (see FIG. 5). The sockets 122 are cylindrically shaped and project vertically within the metal connectors 120. The sockets 122 are sized and configured to slidably receive the pistons 110.

The metal connectors 120 that present the sockets 122 are attached to respective ends of the metal strip 118. The metal strip 118 is configured to transmit electric current between the connectors 120 and thereby generate enough heat to seal the open margin M. However, it is within the ambit of the present invention where the seal bar 106 is alternatively configured.

With the seal bar 106 mounted on the pistons 110, the pistons 110 can be shifted at the same time to move the seal bar 106 upwardly relative to the container pan 90 to be brought into engagement with a seal strip 124 of the lid 92 (see FIGS. 5 and 6). Similarly, the pistons 110 can be shifted at the same time to move the seal bar 106 downwardly relative to the container pan 90 and space the seal bar 106 below the seal strip 124.

Turning to FIGS. 2 and 5-13, the container pan 90 preferably comprises a unitary pan and includes a floor 126, an outer rim 128, and a side wall 130 that interconnects the floor 126 and the rim 128. The pan 90 further includes a pair of spaced apart hinge housings 132 and a pair of stops 134 supported by the hinge bodies 132 (see FIGS. 10-13).

The pan 90 also presents an open top 136 surrounded by the outer rim 128 and an upwardly facing container seal face 138 (see FIGS. 2 and 7). The vacuum chamber 22 projects into the pan 90 from the open top 136 and presents a maximum length dimension Ld, a maximum width dimension Wd, and a maximum depth dimension Dd (see FIGS. 2 and 5). The maximum length dimension Ld preferably ranges from about ten centimeters (10 cm) to about thirty centimeters (30 cm) and, more preferably, is about eighteen centimeters (18 cm). The maximum width dimension Wd preferably ranges from about ten centimeters (10 cm) to about fifty centimeters (50 cm) and, more preferably, is about thirty-five centimeters (35 cm). The maximum depth dimension Dd preferably ranges from about five centimeters (5 cm) to about thirty centimeters (30 cm) and, more preferably, is about ten centimeters (10 cm).

If desired, the chamber 22 need not be rectangular shaped, as other suitable shapes and sizes are within the ambit of the present invention. For example, the chamber 22 could alternatively be dimensioned to specifically match the shape and size of the item to be sealed in the bag. Moreover, the chamber 22 is importantly dimensioned and configured to cradle the desired chamber packaging operations.

As will be discussed, the seal face 138 is configured to be engaged by the seal 94. Preferably, the illustrated container seal face 138 is presented by the rigid structure of the outer rim 128. This configuration enables the seal 94 to be brought into firm engagement with the container seal face 138. Also, the container seal face 138 is preferably substantially planar to provide continuous engagement between the container seal face 138 and the seal 94.

However, the container pan 90 could be alternatively shaped and/or configured to be brought into sealing engagement with the lid 92. For instance, the container seal face 138 could present a nonplanar shape (e.g., where the container seal face 138 is defined by one or more projections, ridges, channels, and/or undulations positioned along the length of the rim 128). In another alternative embodiment, the container pan 90 could include an elongated yieldable seal (e.g., similar to seal 94) that engages and is deformed by the lid 92 when the lid 92 is closed. The illustrated container pan 90 is preferably mounted to the cabinet 30 so that the pan 30 and cabinet 30 cooperatively provide a base 139, with the pan 90 projecting into the compartment 48.

Turning to FIGS. 2, 5, 6, and 9-11, the container lid 92 is elongated to present swingable and hinged lid ends 140,142 (see FIGS. 10 and 11). The lid 92 is preferably shiftably attached to the pan 90 adjacent the hinged end 142 to move between the open position and the closed position. Preferably, the lid 92 has a rigid construction and includes a lid body 144, hinge pins 146, and the seal strip 124.

The lid body 144 is preferably rigid and includes an upper wall 150, an outer rim 152, reinforcing interior ribs 154, handles 156, and an interior mounting wall 158 that are integrally formed with one another (see FIGS. 2, 5, and 6). The upper wall 150 preferably defines a generally continuous convex outer shape of the lid 92, although the lid 92 could be variously shaped. The ribs 154 extend along an interior surface of the upper wall 150 and interconnect the outer rim 152 and upper wall 150 to one another to reinforce the lid 92. The mounting wall 158 preferably extends laterally along the interior surface of the upper wall 150 and receives and supports the seal strip 124.

The lid 92 preferably spans the open top 136 of the container pan 90 when the lid 92 is in the closed position. The upper wall 150, rim 152, and handles 156 cooperatively present a convex exterior surface of the lid 92. The illustrated handles 156 are located adjacent the swingable end 140 of the lid 92 and form respective corners of the lid 92. The outer rim 152 and lid body 144 cooperatively present recessed corner openings 160 located adjacent the hinged end 142 of the lid 92 (see FIGS. 2, 10, and 11). Also, the outer rim 152 preferably presents a groove 162 and a rim seal face 164 that extend endlessly to receive the seal 94 (see FIG. 8).

Preferably, the lid body 144 further includes a pair of stops 166 that project from respective portions of the outer rim 152 (see FIGS. 9-11). In the illustrated embodiment, each stop 166 comprises a generally rectangular tab that presents an outermost end surface 168. Each stop 166 preferably has a generally rectangular and planar shape, such that the stop 166 presents parallel side surfaces 169 that extend between the end surface 168 and the rim seal face 164 (see FIG. 9). Also, the illustrated stop 166 presents a stop height dimension S measured between the rim seal face 164 and the end surface 168 (see FIG. 8). The stop height dimension S preferably ranges from about one hundredth of an inch (0.01") to about one half of an inch (0.5") and, more preferably, is about one hundred fifty-five thousandths of an inch (0.155").

The stops 166 cooperatively define a laterally extending slot T therebetween. As will be discussed, the slot T is configured to receive the open margin M of the vacuum bag B2 during the external packaging operation.

For some aspects of the present invention, each of the stops 166 could have an alternative shape and/or configuration. Also, the stops 166 could be alternatively positioned relative to the lid 92. For instance, while the illustrated stops 166 preferably project downwardly from the rim seal face 164, the stops 166 could project downwardly from adjacent the rim seal face 164. Further, the lid 92 could have an alternative number of stops 166.

It will also be appreciated that one or more of the stops 166 could be provided as part of the container pan 90 or the seal 94. Yet further, a combination of at least two of the container pan 90, lid 92, and seal 94 could each include one or more stops 166.

The stops 166 could also be alternatively configured without departing from the spirit of the present invention. For example, it is not necessary for the stops to be formed as rectangularly shaped tabs or even be similar shaped. For instance, the stops 166 could alternatively be corrugations, ribs, or other suitable projections which limit compression of the seal 94, as will be described.

The lid body 144 preferably includes a synthetic resin material that is molded to form a rigid lid construction. However, it is within the scope of the present invention where the lid body 144 includes one or more alternative materials (e.g., stainless steel, aluminum, etc.).

The hinge pins 146 are secured to the lid body 144 adjacent the hinged lid end 142 and project laterally into the corner openings 160. The hinge pins 146 are shiftably mounted within slotted openings 170 presented by the hinge housing 132 to form hinge joints 172 (see FIGS. 10 and 11). Preferably, the hinge joints 172 pivotally mount the lid 92 to the container pan 90 so that the lid 92 can swing relative to the pan 90 between the open and closed positions. However, the illustrated hinge joints 172 also preferably permit the hinge pins 146 to slide vertically within the slotted openings 170.

While the illustrated hinge joints 172 are preferred for shiftably mounting the lid 92 onto the pan 90, the principles of the present invention are applicable where an alternative mechanism is used to mount the lid 92. For instance, the hinge housings 132 could be formed as part of the lid 92 and the hinge pins 146 could be provided as part of the base 139. Also, instead of using a pair of pivoting hinges, the machine 20 could include a four bar linkage for shiftably mounting the lid 92 to the pan 90.

In the closed position, the end surfaces 168 engage the container seal face 138 to support the lid 92 relative to the container pan 90 (see FIG. 11). When the lid 92 is closed, the hinge pins 146 are located in a lowermost position within the slotted openings (see FIG. 11). Also in the closed position, the rim seal face 164 and container seal face 138 oppose one another and are spaced apart to cooperatively define a sealing gap 174. As will be discussed, the seal 94 spans the sealing gap 174 and sealingly engages the seal faces 138,164 during evacuation of the vacuum chamber 22 and vacuum bag B1,B2.

Again, the vacuum container 32 preferably includes the pan 90, lid 92, and seal 94, which cooperatively form the vacuum chamber 22. When the lid 92 is closed, the seal 94 spans the sealing gap 174, which permits evacuation of the vacuum chamber 22 and the vacuum bag B1,B2.

The seal 94 preferably comprises a continuous unitary seal structure. The illustrated seal 94 preferably includes a support rib 176, a flange section 178, and a lip 180 (see FIG. 8). The flange section 178 presents a flange face 182 that engages the rim seal face 164. Preferably, the lip 180 comprises a strip of material with a generally constant thickness. The lip 180 also preferably projects at an angle A relative to the flange face 182 (see FIG. 8). The angle A preferably ranges from about ten degrees (10°) to about fifty degrees (50°) and, more preferably, is about thirty degrees (30°). However, the lip 180 could be alternatively sized and/or shaped without departing from the scope of the present invention.

Figure 8:
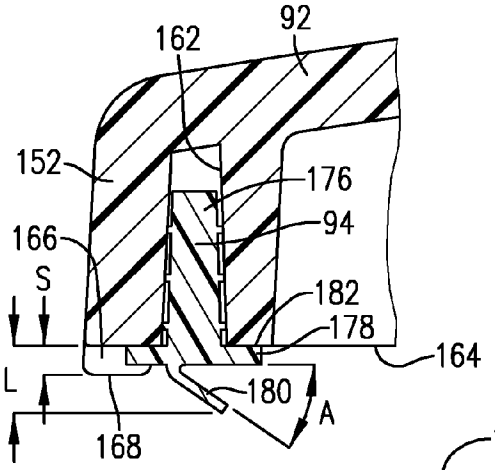
FIG. 8 is a greatly enlarged fragmentary cross section of the lid shown in FIGS. 1-6, to detailedly depict the groove formed in an outer rim of the lid and the elongated seal secured to the lid.

The flange section 178 and lip 180 cooperatively define a seal height dimension L measured between the flange face 182 and an edge 184 of the lip 180 (see FIG. 8). The seal height dimension L preferably ranges between about one tenth of an inch (0.1") and about one half of an inch (0.5"). However, it is within the ambit of the present invention where the seal L has an alternative size and/or configuration.

The seal 94 preferably includes a synthetic resin material and, more preferably, includes an elastic silicone material. However, for some aspects of the present invention, the seal 94 could include other materials.

When the lid 92 is closed, the seal 94 is configured to span the sealing gap 174 by sealingly engaging the seal faces 138,164. In particular, the flange face 182 engages the rim seal face 164 and the edge 184 engages the container seal face 138. Thus, during evacuation of the vacuum chamber 22 and vacuum bag B1,B2, the seal 94 restricts air from entering the vacuum chamber 22. As will be discussed, the seal 94 and stops 166 are configured to restrict the vacuum bag B2 from being pinched closed by the lid 94 during operation of the machine 20 in the external packaging mode.

Again, the seal bar 106 is mounted on and is shiftable by the cylinders 104 upwardly and downwardly relative to the container pan 90 to be brought into and out of engagement with the seal strip 124 of the lid 92. The illustrated seal bar 106 extends substantially parallel to a laterally extending section of the container seal face 138. At the same time, the seal bar 106 is spaced apart from the pan 90 so that the pan 90 does not restrict upward and downward seal bar movement.

Turning to FIGS. 5-7 and 12, the illustrated bag clamp 96 is operable to selectively grasp the open margin M of the vacuum bag B1 during evacuation thereof in the chamber packaging mode. That is, the bag clamp 96 is designed to grasp the open margin M of the vacuum bag B1 when the vacuum bag B1 is located entirely within the vacuum chamber 22.

The bag clamp 96 preferably includes a stationary base 186, a slidable clip 188 that is slidably mounted on the base 186, and a linkage 190 that interconnects the base 186 and the clip 188 (see FIG. 7). The base 186 preferably includes an angled plate with upright stanchions 192 and a pair of spaced apart posts 194.

The clip 188 is unitary and includes a pair of tabs 196 (see FIGS. 5 and 12) and presents slotted openings (not shown). The openings slidably receive the stanchions 192 to permit vertical movement of the clip 188 relative to the base 186. The clip 188 is slidable up and down between a clamping position (see FIGS. 5 and 6), where the tabs 196 engage upper ends of the posts 194, and an open position (see FIG. 7), where the tabs 196 are spaced above the upper ends of the posts 194.

To grasp the open margin M of the vacuum bag B1, the bag clamp 96 is initially positioned in the open position so that the bag clamp 96 can receive the open margin M. With the open margin M located between the tabs 196 and the posts 194, the bag clamp 96 can be shifted from the open position to the clamping position to grasp the open margin M.

When the open margin M of the vacuum bag B1 is grasped by the bag clamp 96 in the clamping position, the bag clamp 96 preferably restricts movement of the open margin M relative to the vacuum container 32. More preferably, the bag clamp 96 restricts lateral movement of the open margin M relative to the seal bar 106. As a result, the bag clamp 96 holds the open margin M steady during evacuation and sealing of the vacuum bag B1. By holding the open margin M steady, the bag clamp 96 permits the seal bar 106 to form an airtight seal line along the entire lateral extent of the open margin M.

To release the bag clamp 96 from clamping engagement with the open margin M of the vacuum bag B1, the bag clamp 96 is initially shifted from the clamping position to the open position. The vacuum bag B1 can then be selectively removed from the open bag clamp 96.

Turning to FIGS. 8-11, the slot T is configured to receive the open margin M of the vacuum bag B2 when the lid 92 is closed and the machine 20 is used in the external packaging operation. The seal 94 and stops 166 cooperate to restrict the vacuum bag B2 from being pinched closed by the lid 96 during evacuation of the vacuum bag B2 in the external packaging mode. Preferably, the seal 94 and stops 166 are sized so that the seal height dimension L is greater than the stop height dimension S (see FIG. 8). This results in the seal 94 being compressed in the closed position. However, the seal 94 and stops 166 are also preferably sized so that the edge 184 of the seal 94 is spaced from the flange section 178 in the closed position. That is, when the lid 92 is closed, the lip 180 is preferably not flexed toward the flange section 178 so far that the edge 184 of the seal 94 contacts the flange section 178.

The percentage size difference of the seal height dimension L over the stop height dimension S preferably ranges from about fifty percent (50%) to about four hundred percent (400%) and, more preferably, is about two hundred fifty percent (250%).

In operation, the vacuum packaging machine 20 can be used to evacuate and seal vacuum bags B1,B2 with their contents using, respectively, the chamber packaging operation mode and the external packaging operation mode. Initially, vacuum bag B1 and its contents are placed entirely within the vacuum chamber 22 of the vacuum packaging machine 20 for evacuation and sealing using the chamber packaging operation mode. The open margin M of the vacuum bag B1 is secured to the bag clamp 96. The lid 92 is then swung closed so that the seal 94 engages the container seal face 138 (see FIG. 9). The user can then begin to evacuate the vacuum chamber 22. In some instances, the lid 92 may not be in the closed position prior to evacuating the chamber 22 (see, e.g., FIG. 10, where the portion of the lid 92 adjacent the hinge joints 172 is not fully closed). In that case, the process of evacuating the chamber 22 causes the lid 92 to shift downwardly into the closed position (see FIG. 11).

During the process of evacuating air from the vacuum chamber 22, the vacuum bag B1 is also evacuated through the open margin M thereof. The open margin M of the vacuum bag B1 is sealed closed after the vacuum bag B1 has been evacuated. During the sealing process, the vacuum condition within the chamber 22 is preferably maintained. Once the sealing process is complete, the machine 20 vents the chamber 22 to ambient so that air can return to the chamber 22.

After venting the vacuum chamber 22 to ambient, the sealed vacuum bag B1 and contents can be removed from the vacuum chamber 22. Specifically, the user first swings the lid 92 to the open position to gain access to the vacuum chamber. The user can then remove the sealed vacuum bag B land contents from the vacuum chamber 22.

Once the vacuum bag B1 and contents have been sealed and removed from the machine 20, the chamber packaging operation (with a new bag B1 and its contents) can be repeated, or the vacuum bag B2 and its contents can be placed on the machine 20 for evacuation and sealing using the external packaging operation mode. The vacuum bag B2 is located only partly within the vacuum chamber 22 so that the open margin M thereof is located within the vacuum chamber. Furthermore, the remainder of the vacuum bag B2 and its contents are positioned outside of the vacuum chamber 22 and supported on the cabinet 30. In particular, the bag-supporting surface 61 of the access cover 38 is operable to support the vacuum bag B2 and its contents (e.g., see FIG. 13). Optionally, the bag-supporting face 79 of the shelf assembly 34 can cooperate with the bag-supporting surface 61 to receive and support the vacuum bag B2 along with its contents.

After placing the vacuum bag B2 and its contents, the lid 92 is then swung closed so that the seal 94 engages the container seal face 138 (see FIG. 9). The seal 94 also engages the part of the vacuum bag B2 that extends across the seal face 138 and through the slot T. Again, the stops 166 cooperate with the seal 94 to restrict the lid 92 from pinching the vacuum bag B2 closed along the seal face 138.

With the lid 92 swung closed, the user can then begin to evacuate the vacuum chamber 22. Again, if the lid 92 is not in the closed position prior to evacuating the chamber 22, the process of evacuating the chamber 22 causes the lid 92 to shift downwardly into the closed position (see FIG. 11).

During the process of evacuating air from the vacuum chamber 22, the vacuum bag B2 is evacuated through the open margin M. Once the bag B2 is evacuated, the open margin M of the vacuum bag B2 is then sealed closed. Again, during the sealing process, the vacuum condition within the chamber 22 is preferably maintained. Once the sealing process is complete, the machine 20 vents the chamber 22 to ambient so that air can return to the chamber 22. The sealed vacuum bag B2 and contents can then be removed from the vacuum chamber 22 by opening the lid 92.

While the external packaging operation is described as occurring after the chamber packaging operation, the principles of the present invention are applicable where the external packaging operation occurs before the chamber packaging operation. Furthermore, it will be appreciated that each of multiple vacuum bags can be evacuated and sealed one after another using one of the operations of the vacuum packaging machine 20. For instance, the steps associated with the external packaging operation can be repeated multiple times in series to vacuum and seal multiple bags. Similarly, the steps associated with the chamber packaging operation can be repeated multiple times in series to vacuum and seal multiple bags. It will also be appreciated that the illustrated machine 20 can be used to evacuate and seal multiple vacuum bags at the same time (e.g., where the open margins of the bags are spaced along the length of the seal bar 106).

Although the above description presents features of preferred embodiments of the present invention, other preferred embodiments may also be created in keeping with the principles of the invention. Such other preferred embodiments may, for instance, be provided with features drawn from one or more of the embodiments described above. Yet further, such other preferred embodiments may include features from multiple embodiments described above, particularly where such features are compatible for use together despite having been presented independently as part of separate embodiments in the above description.

The preferred forms of the invention described above are to be used as illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventors hereby state their intent to rely on the Doctrine of Equivalents to determine and assess the reasonably fair scope of the present invention as pertains to any apparatus not materially departing from but outside the literal scope of the invention as set forth in the following claims.

What is claimed is:

1. A combination chamber and external suction vacuum packaging machine operable to evacuate a vacuum bag and seal closed an open margin of the bag, said vacuum packaging machine comprising:

a vacuum container defining a vacuum chamber dimensioned and configured for use in a chamber packaging operation, wherein the bag is entirely received within the vacuum chamber, and an external packaging operation, wherein the margin and only part of the bag is received within the vacuum chamber;

a vacuum source in communication with the vacuum chamber, said vacuum source being operable to evacuate the vacuum chamber and thereby the vacuum bag through the open margin thereof, during chamber packaging and external packaging operations;

a seal bar operable to engage and seal closed the open margin of the vacuum bag after the vacuum bag has been evacuated, said vacuum container presenting opposed seal faces spaced apart to define a sealing gap therebetween, said vacuum container including a compressible seal configured to span the sealing gap and sealingly engage the seal faces during evacuation of the vacuum chamber and vacuum bag, said seal faces moving toward one another to decrease the sealing gap as the seal is compressed during evacuation of the vacuum chamber and vacuum bag; and a stop configured to limit compression of the seal during chamber packaging and external packaging operations and thereby define a minimum seal gap dimension, said stop being spaced away from the seal bar.

2. The vacuum packaging machine as claimed in claim 1, said stop being located outside of the vacuum chamber.

3. The vacuum packaging machine as claimed in claim 2, said seal bar being located within the vacuum chamber, with the seal extending at least partly between the stop and the seal bar.

4. The vacuum packaging machine as claimed in claim 2, said stop projecting from one of the seal faces to engage the other one of the seal faces when the chamber is evacuated.

5. The vacuum packaging machine as claimed in claim 2, said seal bar comprising the only bag heating component of the vacuum packaging machine.

6. The vacuum packaging machine as claimed in claim 1, said stop comprising a pair of spaced apart tabs.

7. The vacuum packaging machine as claimed in claim 6, said tabs being spaced on opposite sides of seal bar.

8. The vacuum packaging machine as claimed in claim 7, said tabs being located outside of the vacuum chamber.

9. The vacuum packaging machine as claimed in claim 7, said seal bar being located within the vacuum chamber, with the seal extending at least partly between each tab and the seal bar.

10. The vacuum packaging machine as claimed in claim 8, said tabs projecting from one of the seal faces to engage the other one of the seal faces.

11. The vacuum packaging machine as claimed in claim 6, said tabs defining a slot therebetween, said slot being configured to receive the open margin of the bag therethrough during the external packaging operation.

12. The vacuum packaging machine as claimed in claim 11, each of said tabs projecting from one of the seal faces, each of said tabs presenting an outermost end surface spaced outwardly from the one seal face to engage the other one of the seal faces when the chamber is evacuated, each of said tabs presenting a pair of at least substantially parallel side surfaces extending between the end surface and the one seal face.

13. The vacuum packaging machine as claimed in claim 1, said vacuum container including a container pan and a container lid shiftably supported relative to one another for movement into and out of a closed position and presenting respective ones of the seal faces.

14. The vacuum packaging machine as claimed in claim 13, said stop comprising a pair of spaced apart tabs formed as part of the lid.

15. The vacuum packaging machine as claimed in claim 14, said tabs being spaced on opposite sides of seal bar.

16. The vacuum packaging machine as claimed in claim 15, said tabs being located outside of the vacuum chamber.

17. The vacuum packaging machine as claimed in claim 15, said tabs defining a slot therebetween, said slot being configured to receive the open margin of the bag therethrough during the external packaging operation.

18. The vacuum packaging machine as claimed in claim 13, said seal including a flange section that flatly engages and is fixed relative to the seal face presented by the container lid, said seal including a flexible lip projecting from the flange section to the seal face of the container pan in the closed position.

19. The vacuum packaging machine as claimed in claim 1, said seal including a flange section that flatly engages and is fixed relative to a respective one of the seal faces, said seal including a flexible lip projecting from the flange section toward the other one of the seal faces.

20. The vacuum packaging machine as claimed in claim 1, said seal bar comprising the only bag heating component of the vacuum packaging machine.

* * * * *